US007146738B2

(12) United States Patent
Yu

(10) Patent No.: US 7,146,738 B2
(45) Date of Patent: Dec. 12, 2006

(54) HOLE PUNCHER

(76) Inventor: Chiu-Hsia Yu, PO Box 82-144, Taipei (TW)

( * ) Notice: Subject to any disclaimer, the term of this patent is extended or adjusted under 35 U.S.C. 154(b) by 0 days.

(21) Appl. No.: 11/042,099

(22) Filed: Jan. 26, 2005

(65) Prior Publication Data

US 2006/0162170 A1 Jul. 27, 2006

(51) Int. Cl.
*B26F 1/00* (2006.01)
*B25G 1/00* (2006.01)

(52) U.S. Cl. ..... 30/358; 30/340; 30/360; 30/363; 30/364; 81/351; 81/426.5; 72/325

(58) Field of Classification Search ..... 30/340, 30/363, 349, 177, 186, 244, 301, 366, 189, 30/364, 358, 360, 362; 83/905; D8/52, D8/98, 51, 106; 72/325, 326, 311, 409.1; 81/349, 342, 343, 351, 426.5
See application file for complete search history.

(56) References Cited

U.S. PATENT DOCUMENTS 484,891 A * 10/1892 Fairfield ..... 30/364
664,299 A * 12/1900 Smith ..... 30/364
734,157 A * 7/1903 Bernard ..... 30/364
1,126,324 A * 1/1915 Weinstein ..... 227/78
1,308,272 A * 7/1919 Berglund ..... 30/364
1,391,890 A * 9/1921 Green ..... 30/364
1,848,021 A * 3/1932 Miller ..... 30/364
3,250,450 A * 5/1966 Le Page et al. ..... 227/144
3,879,848 A * 4/1975 Murphy ..... 30/366
4,193,191 A * 3/1980 Sisco ..... 30/364
5,022,253 A * 6/1991 Parlatore ..... 72/325
D436,302 S * 1/2001 Lin ..... D8/52
2002/0124420 A1* 9/2002 Hsuan ..... 30/363
2003/0089755 A1* 5/2003 Peers-Smith et al. ..... 225/103

* cited by examiner

*Primary Examiner*—Boyer D. Ashley
*Assistant Examiner*—Ghassem Alie
(74) *Attorney, Agent, or Firm*—Leong C. Lei

(57) ABSTRACT

A hole-puncher having a roller module with knife protrusions and a mold module roller which are pivotally mounted to mouth sections of the hole-puncher. The knife protrusion roller module is provided with knife head protrusions of various sizes and at least a punching protrusion, and the mold module roller is provided with a plurality of knife mold seats and at least a chopping block. The knife mold seats are provided with protrusions, thereby holes can be punched by rotating the knife roller corresponding to the knife mold seat or the chopping block.

1 Claim, 8 Drawing Sheets

PRIOR ART

PRIOR ART

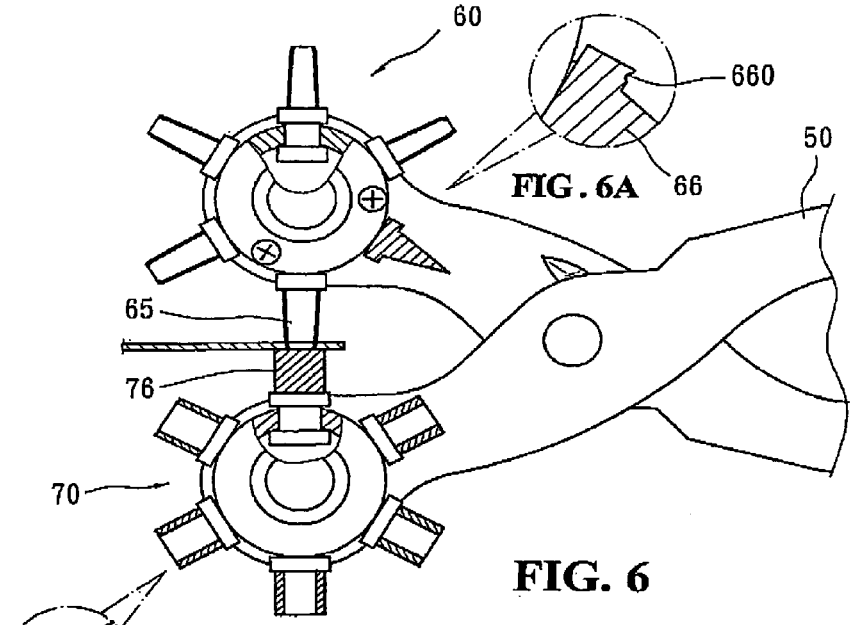
FIG. 6A
FIG. 6
FIG. 6B
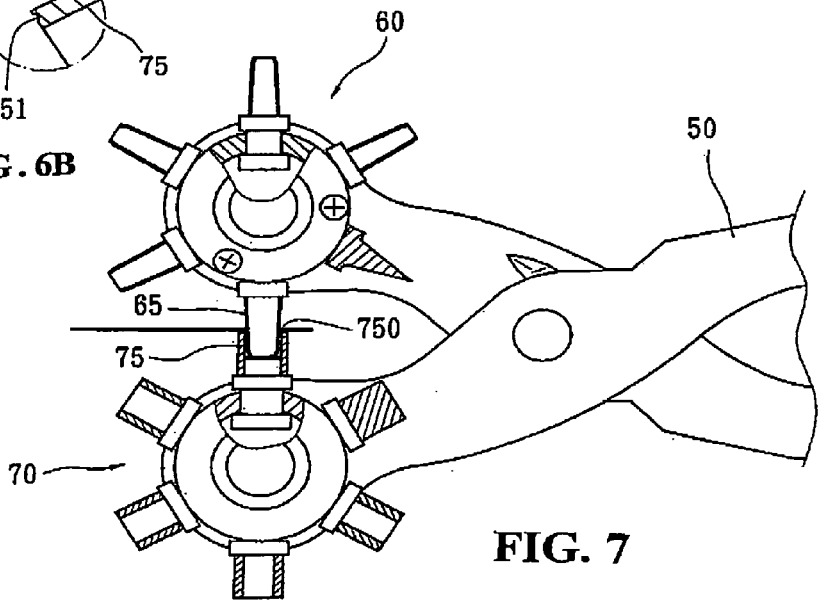
FIG. 7

HOLE PUNCHER

BACKGROUND OF THE INVENTION (a) Technical Field of the Invention

The present invention relates to a hole puncher, and in particular, to a puncher which punches holes on paper or belts or the like. The puncher provides selectable knife-head protrusion and knife-mold seat.

(b) Description of the Prior Art

FIG. 1 is a conventional hole puncher having two alternating pivoted handles 10 forming to a mouth section 15. The mouth section 15 is provided with corresponding screw hole 16. The screw hole 16 is locked with a corresponding chopping block 20 and a knife head protrusion 25. The knife head protrusion 25 is used to proceed with punching hole and the chopping block 20 is used as a flat surface. FIG. 2 is another hole-puncher having a mouth section 15 and one side of the mouth section 15 is locked with a knife mold seat 30 with a protrusion hole 31. The other side of the mouth section 15 is locked with a knife head protrusion 35. The knife head protrusion 35 is appropriately inserted into the protrusion hole 31 of the mold seat 30.

One side of the handle 10 is provided with a plurality sizes of knife head protrusions 35A, 35B. The drawback of this hole puncher is that when different knife head protrusion 35 is changed, the knife head protrusion 35 needs to be dismantled and then follow by other components. This procedure is tedious.

FIG. 3 shows another conventional hole puncher having a roller 40 and a chopping block 45 at the mouth section 15 of the two alternating handles 10. The roller 40 has a rotating disc 41 pivotally mounted to the mouth section 15. There are pluralities of protrusions 42 of various sizes mounted on the rotating disc 41. This allows the section of knife head protrusions 42. However, the protrusions 42 cannot flatly position with the chopping block 45, it is frequent that the cutting is not smooth or not in alignment.

In view of the above, the drawbacks of the conventional hole punchers include:

1. the hole puncher is only applicable soft type of paper board or leather, and it is not applicable to thin metallic board,
2. the hole puncher does not provide neat hole-punching.

SUMMARY OF THE INVENTION

The primary purpose of the present invention is to provide a hole-puncher having two mounted handles. On the end of one handle is a mouth section, characterized by a roller module with knife protrusions, and a mold module roller at the end of the other handle. Both modules are mounted to the mouth sections. The knife protrusion roller module provides a knife head with protrusions of various sizes, which includes a punching protrusion. The roller module is provided with a plurality of mold seats, which includes a chopping block. The knife mold seat is provided with punching protrusions with these punching protrusions, holes can be punched by rotating the knife mold roller that corresponds with the knife mold seat or the chopping board.

Yet still another object of the present invention is to provide a hole puncher, wherein the knife protrusion roller module is provided with two capped rotating discs, and the center of the rotting disc is a circular pivot section. The inner face of the two rotating discs is provided with a plurality of clipping slots. The end section of the mouth section is formed with corresponding pivotal lugs whereas the center of the lug is a pivotal hole corresponding to the pivotal section for the mounting of the roller module.

A further object of the present invention is to provide a hole puncher, wherein the center of the pivotal lug is formed with pivot hole for pivotal mounting of the knife mold roller module.

Another further object of the present invention is to provide a hole puncher, wherein between the knife protrusion roller module and the knife mold roller module and the mouth section is a position strut wherein an elastic element and a position bead are positioned to one side of the rotating disc of the knife protrusion roller module and the knife mold roller module and the inner face of the pivotal lug corresponding to the mouth section is formed with a plurality of equidistance position slot for restriction of the position bead at the position slot A further object of the present invention is to provide a hole puncher, wherein the circumferential edge of the punching protrusion is a recessed slot and the end ice of the knife mole roller module is another recessed slot for the urging of the first protruded edge of the punching button, and to press the other end of the button to form a second protruded edge.

Another further object of the present invention is to provide a hole puncher, wherein the position slot is for the restriction of the steel bead within the position slot.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and fates of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 6 is a schematic view of a first application, illustrating the relationship of the knife head protrusion and the chop board, of the present invention.

FIG. 6A is an enlarged view of a portion of the punching protrusion of FIG. 6.

FIG. 6B is an enlarged view of a portion of the knife mold seat of FIG. 6.

FIG. 7 is a schematic view of a second application, illustrating the relationship of the knife head protrusion and the knife-mold seat, of the present invention.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figures 1, 1A:
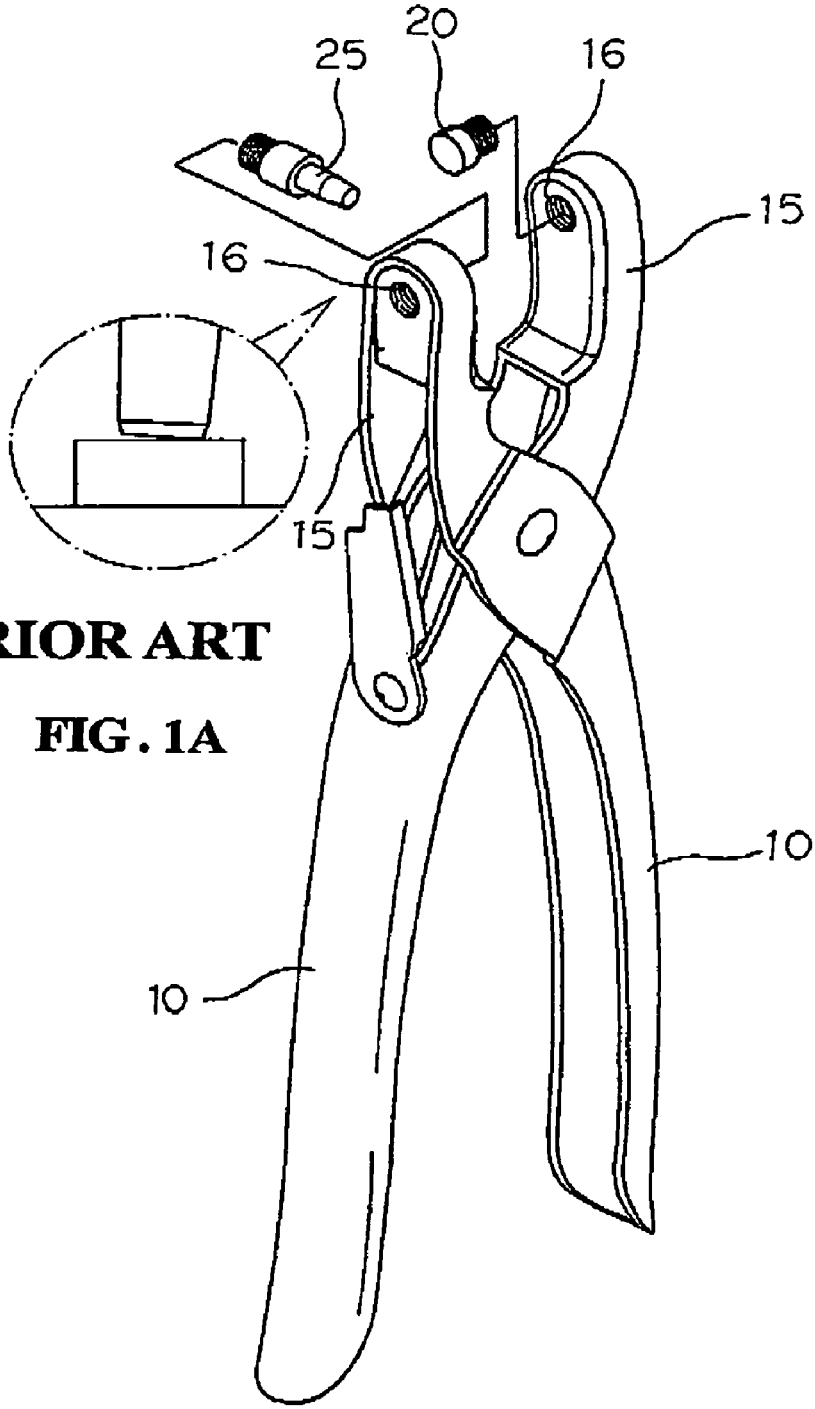
FIG. 1A PRIOR ART
FIG. 1 is a perspective view of a conventional hole-puncher.
FIG. 1A is an enlarged view showing the working principle of the conventional hole-puncher.
Figures 2, 2A:
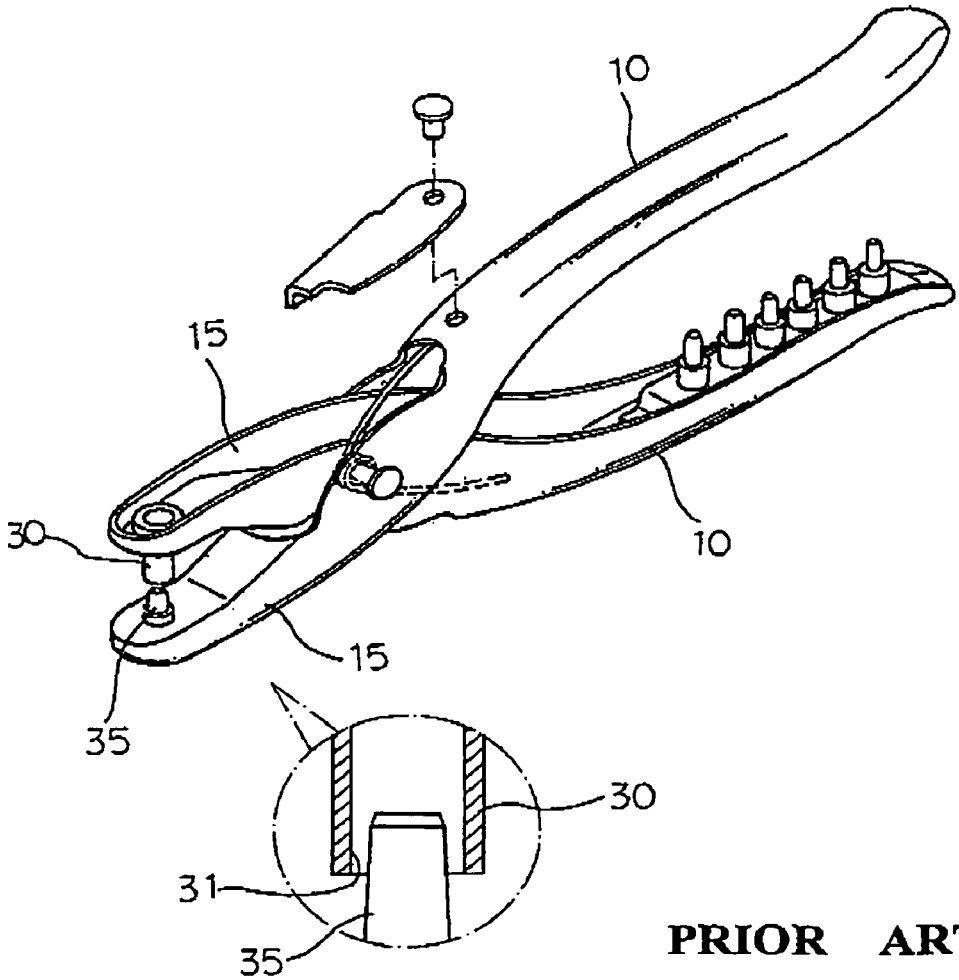
FIG. 2 PRIOR ART
FIG. 2 is a perspective view of a conventional replaceable-type hole-puncher.
FIG. 2A is an enlarged sectional view showing the relationship between the knife head protrusion and the mold seat of FIG. 2.
Figure 3:
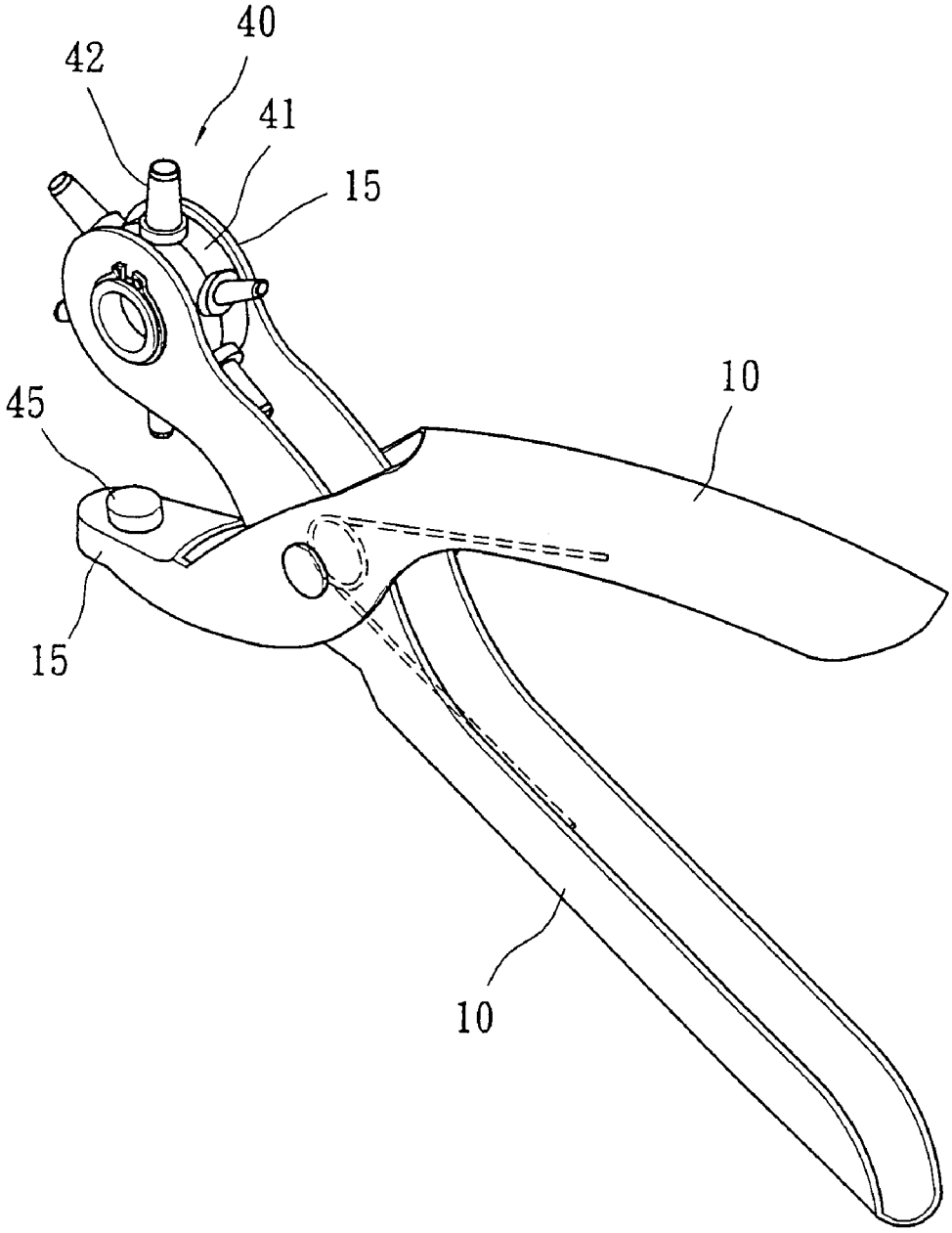
PRIOR ART FIG. 3
FIG. 3 is a perspective view of a conventional roller-type hole-puncher.
Figures 4, 4A, 4B, 4C:
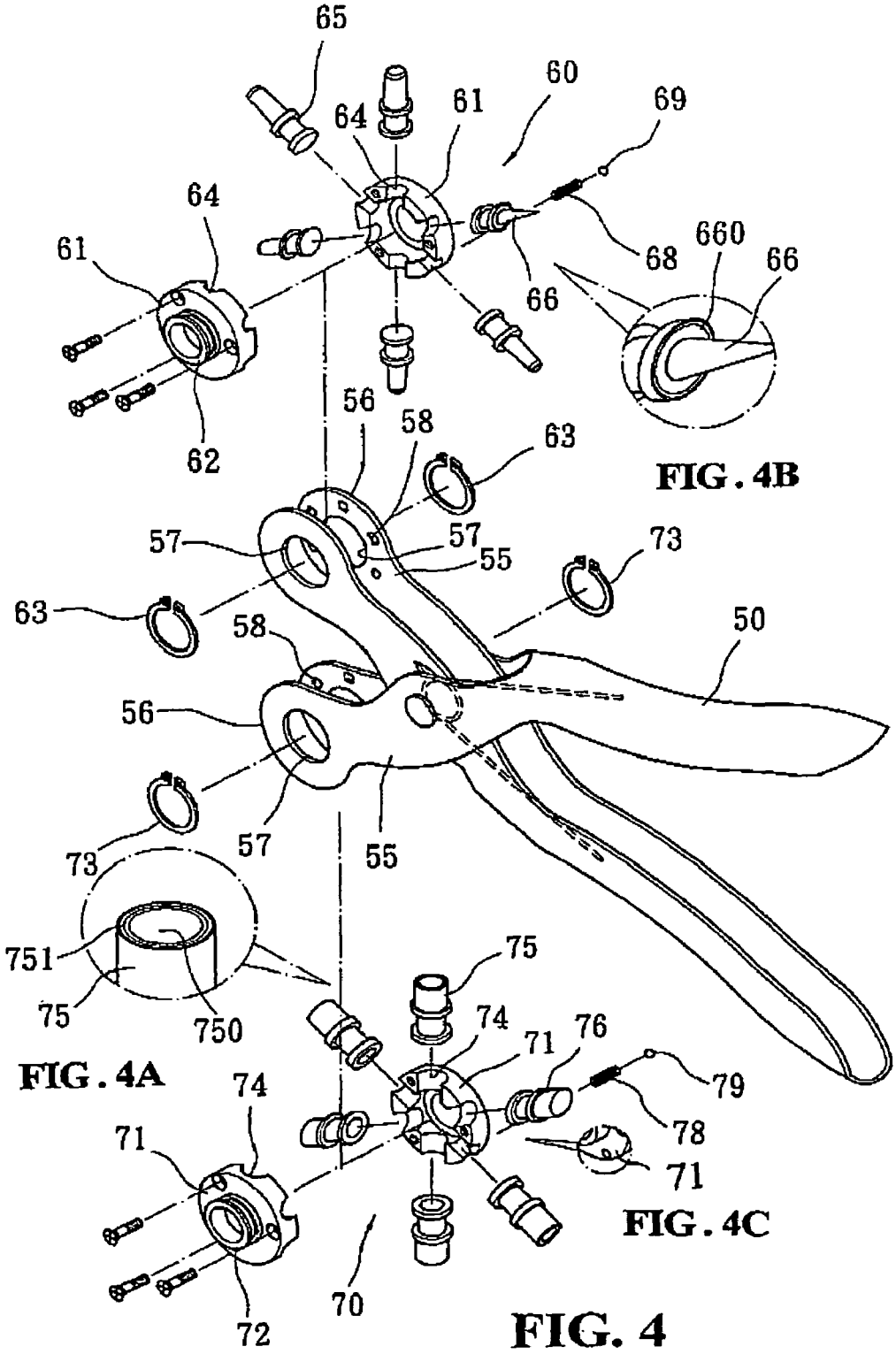
FIG. 4 is a perspective exploded view of a hole-puncher showing the various components in accordance with the present invention.
FIG. 4A is an enlarged view of a portion of the knife mold seat of FIG. 4.
FIG. 4B is an enlarged view of a portion of the punching protrusion of FIG. 4.
FIG. 4C shows a portion of the opposite side of the rotating disc of FIG. 4.
Figure 5:
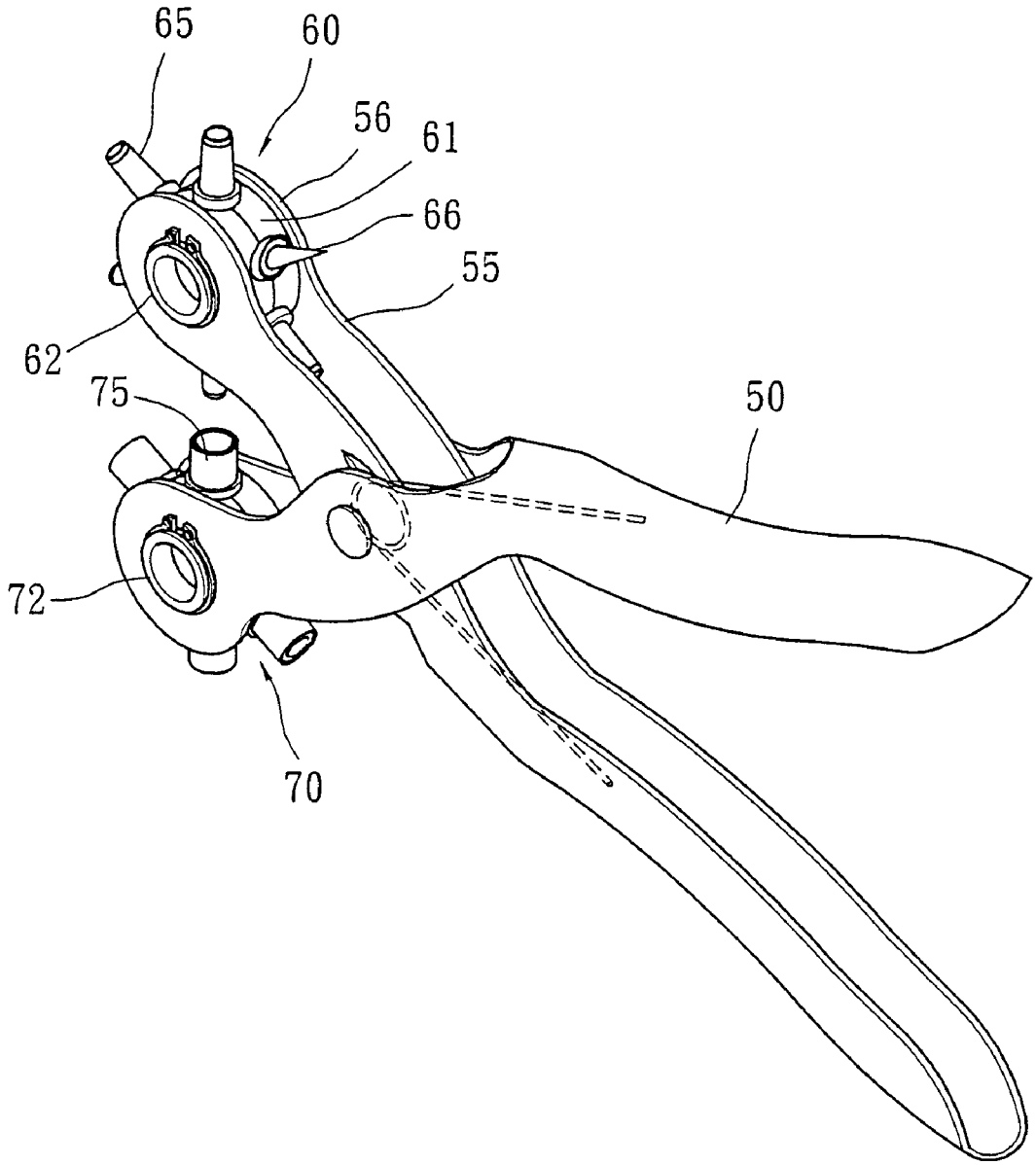
FIG. 5 is a perspective view of a hole-puncher in accordance wit the present invention.

FIGS. 4 and 5 show a hole puncher of the present invention includes two mounted handles 50, and one end of the pivotal point is a corresponding mouth section 55. The handle 50 is used to control the punching pressure and the mouth section 55 is used to produce the hole.

In accordance with the present invention, the mouth section 55 is provided with a knife portion roller module 60 and a knife mold roller module 70. The end portion of the mouth section 55 is formed with two corresponding pivotal lugs 56. The center of the two lateral pivotal lugs 56 is a corresponding hole 57 for respectively mounting the knife protrusion roller module 60 and knife mold roller module 70. The circumferential edge of the pivotal hole 57 is aligned with equidistant position slots 58 for the positioning of the knife protrusion roller module 60 and the knife mold roller module 70.

The knife protrusion roller module 60 possesses two corresponding capped rotating discs 61 which can be attached between two pivotal lugs 56. The center of the two rotating discs 61 is engaged with a pivot shaft section 62 for mounting the pivot hole 57. A C-shaped retainer 63 is used to restrict the shaft section 62. The inner face of the two rotating discs 61 are formed into a plurality of equidistant slots 64, and the slot 64 can be used to attached various knife head protrusions 65 and at least a punching protrusion 66, which has a conical shape in which the circumference of the punching protrusion 66 has a grooved slot 660. The external side of the rotating disc 61 corresponding to a clipping slot 64 allows an elastic element 68 and a position steel bead 69 to fasten into position to the position slot 58 of the pivotal lugs 56. This allows the user to position the selected knife head protrusion 65 or the punching protrusion 66.

The knife mold roller module 70 is also provided with two correspondingly capped-rotating discs 71 and the two discs 71 are attached between the two pivotal lugs 56 of the other mouth section 55. The center of the two rotating discs 71 is provided with recessed pivotal shaft section 72 that corresponds to the pivotal hole 57 of the pivot lug 56 and C-type button 73 is used for locking into place. The inner face of the two rotating disc 71 is formed into a plurality of equidistant slots 74, which corresponds to the clipping slot 64 of the knife-protrusion roller module 60, wherein the gap of adjacent clipping slot 74 is equal to that of the adjacent slot 58 of the pivot lug 56, and the clipping slot 74 is used for the attachment of a plurality of knife mold seats 75 and at least a chopping board 76. The knife mold seat 75 is respectively formed with knife protrusion hole 750, which corresponds to the knife head protrusion 65 and the punching protrusion 66, and the end face of the knife mold seat 75 is formed into a recessed slot 751. The external side of one of the rotating discs 71, which corresponds to clipping slot 74, is provided with an elastic member 78 and a position steel bead 79. And position bead 79 is used to listen into position slot 58, and the user ban select the corresponding knife mold seat 75 or the chopping board 76.

The user rotates the roller module 60 and selects the appropriate knife head protrusion 65 or the punching protrusion 66 to proceed with positioning. To rotate the molding roller module 70 to select the corresponding knife-mold seat 75 with the knife protrusion hole 75 or the chopping board 76, the user presses the side of the shaft 50, the mouth section 55 of the other end will be clipped together to complete the hole punching.

Referring to FIGS. 5 and 6, if the material for punching is thick, the user rotates the roller module 70 such that the chopping board 70 is moved to the position of the knife Profusion roller module 60. Next, the roller module 60 is rotated to employ an appropriate size of the knife head protrusion 65. The two sides of the shaft 50 are clipped so that the corresponding knife head protrusion 65 passes through the chopping board 76. The chopping board 76 is used as a support for the hole punching process.

If a thinner material is to be hole-punched, as shown in FIGS. 5 and 7, the roller module 60 is rotated to an appropriate knife head protrusion 65 to the position of the roller 70. Next the roller 70 is rotated to correspond to the knife mold seat 75 of the hole 750. The two shafts 50 are pressed so that the corresponding knife head protrusion 65 passes trough the knife protrusion hole 750 to complete the hole-punching procedure.

Figure 8:
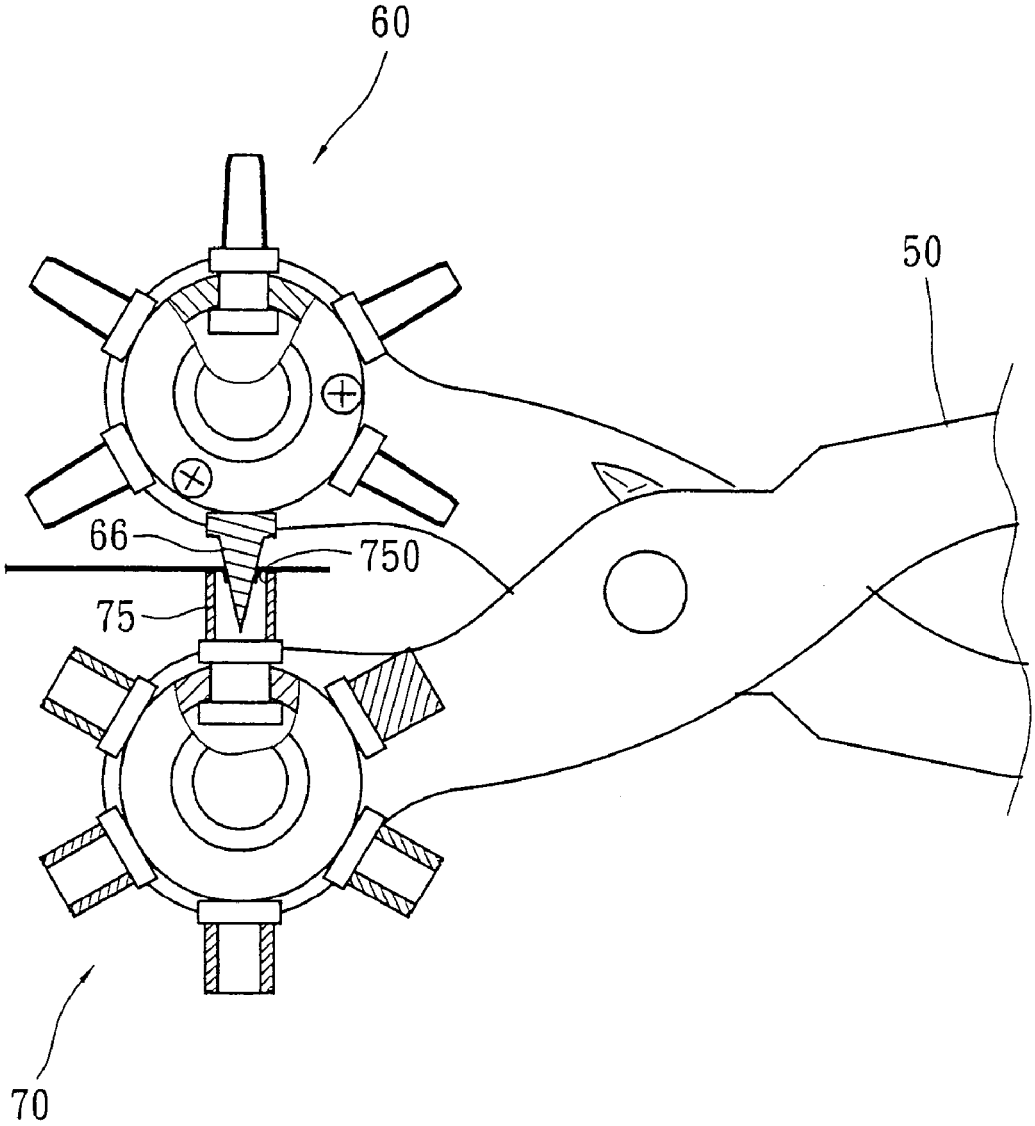
FIG. 8 is a schematic view of a third application illustrating the relationship of the punching protrusion and the knife-mold seat of the present application.

If a thin metal plate is to be hole-punched, as shown in FIGS. 5 and 8, the roller module 60 is rotated so that an appropriate punching protrusion 66 is rotated to the position of the roller module 70. Next, the roller 70 is rotated to correspond to the knife mold seat 75. The two shafts 50 are pressed and the conic shape structure of the punching protrusion 66 passes through the hole 750 to complete the hole punching of the thin metal.

Figure 9:
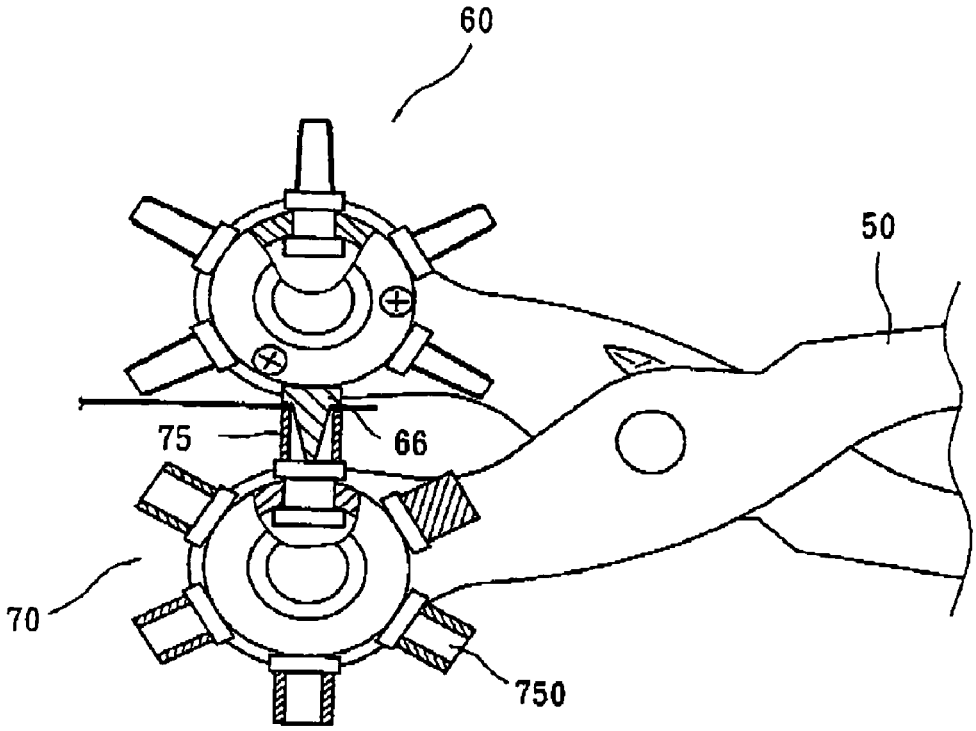
FIG. 9 is a schematic view of a forth application, illustrating the punching protrusion and the knife mold seat, of the present invention.
Figure 9A:
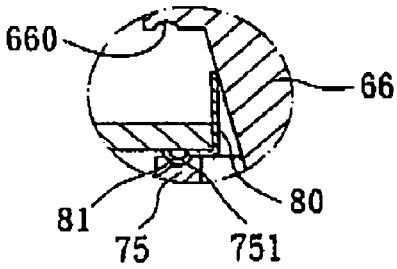
FIGS. 9A and 9B illustrate the working principle of the present invention.
Figure 9B:
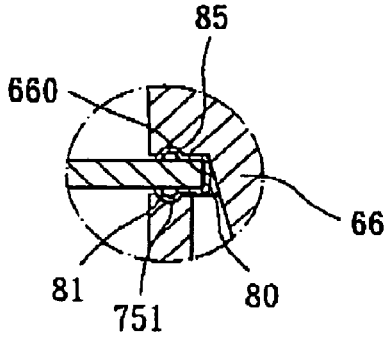

When the user needs to rivet article, as shown in FIGS. 5 and 9, the roller 60 is rotated so that the punching protrusion 66 is moved to the corresponding position of the roller 70. Next, the roller 70 is rotate to the knife mold seat 75 and a rivet 80 is place on the top face of the knife-mold seat 75. The first protruded edge 81 of the rivet 80 is urged against the slot 751 of the mold seat 75 to provide a positioning. The two shafts 50 are pressed so that the conic shaped structure of the punching protrusion 66 is pressed open the other end of the rivet and the slot 660 is formed into a second protruded edge 85.

In view of the above, the top section of the mouth section 55 is pivotally provided with a roller module 60 and the knife mold module 70, and the roller 60 is provided with knife head protrusion 65 and the punching protrusion 66, and the roller 70 is provided with the knife mold seat 75 and the chopping board 76, the user can select the appropriate knife head protrusion or punching protrusion 66, and in combination with different knife mold seat 75 and the chopping board 76, holes of various size can be punched, and material of different thickness can be used.

It will be understood t each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hole puncher comprising a first handle and a second handle pivotally connected with said first handle, said first handle having a first mouth section provided with a knife protrusion roller module, an end portion of said first mouth section being formed with two first pivotal lugs, a center of said first pivotal lugs having a first hole for mounting said knife protrusion roller module, a circumferential edge of said first hole being aligned with equidistant position slots on one of said pivotal lugs for positioning of said knife protrusion roller module, said knife protrusion roller module having two first rotating discs which can be attached between said first pivotal tugs, a center of said first rotating discs being engaged with a pivot shaft section for mounting said first hole, a first C-shaped retainer being used to restrict said shaft section, an inner face of said first rotating discs being formed into a plurality of equidistant slots for attaching various knife head protrusions and at least a punching protrusion, said punching protrusion having a conical shape and a grooved slot at a circumference thereof, an external side of one of said first rotating discs allowing an elastic element and a position steel bead to fasten to a position slot of one of said first pivotal lugs, said second handle having a second mouth section provided with a knife mold roller module, an end portion of said second mouth section being formed with two second pivotal tugs, a center of said second pivotal lugs having a second hole for mounting said knife mold roller module, a circumferential edge of said second hole being aligned with equidistant position slots on the other one of said second pivotal lugs for positioning of said knife mold roller module, said knife mold roller module having two second rotating discs which can be attached between said second pivotal lugs, a center of said second rotating discs being engaged with a pivot shaft section for mounting said second hole, a second C-shaped retainer being used to restrict said shaft section, an inner face of said second rotating discs being formed into a plurality of equidistant slots for attaching various knife mold seats and at least a chopping board, said knife mold seat being formed with a recessed slot, an external side of the other one of said second rotating discs being provided with an elastic member and a position steel bead.

* * * * *